US006167656B1

(12) United States Patent
Devlin et al.

(10) Patent No.: US 6,167,656 B1
(45) Date of Patent: Jan. 2, 2001

(54) SECURITY WINDOW ASSEMBLY

(75) Inventors: Anthony Devlin; Mark J. DiNoto, both of Rochester, NY (US)

(73) Assignee: Fortress Security Windows Inc., Rochester, NY (US)

( * ) Notice: Under 35 U.S.C. 154(b), the term of this patent shall be extended for 0 days.

(21) Appl. No.: 09/265,049

(22) Filed: Mar. 9, 1999

(51) Int. Cl.[7] ..... E06B 3/32; E06B 3/68; E06B 3/26

(52) U.S. Cl. ..... 49/463; 49/57; 52/202

(58) Field of Search ..... 49/463, 465, 466, 49/61, 57, 504; 52/202; 292/256.71, 256.73, 256.75, DIG. 9, DIG. 17, 206, 212, 304; 70/89, 90

(56) References Cited

U.S. PATENT DOCUMENTS

| | | | | |
|---|---|---|---|---|
| 915,593 | * | 3/1909 | Greeno | 292/DIG. 9 X |
| 1,346,065 | * | 7/1920 | Spivak | 292/DIG. 9 X |
| 1,547,048 | * | 7/1925 | Klein | 292/256.75 X |
| 1,936,513 | | 11/1933 | Klauer . | |
| 2,392,678 | | 1/1946 | Loetscher . | |
| 2,623,249 | | 12/1952 | Miller . | |
| 2,700,801 | | 2/1955 | Pierson . | |
| 2,800,956 | * | 7/1957 | Xanten | 49/61 |
| 3,349,517 | * | 10/1967 | Johnson | 49/463 X |
| 3,861,081 | * | 1/1975 | Maskell | 49/463 X |
| 3,978,554 | * | 9/1976 | Miller, Jr. | 49/463 X |
| 4,363,349 | * | 12/1982 | Childs | 49/463 X |
| 4,685,261 | | 8/1987 | Seaquist . | |
| 4,991,369 | | 2/1991 | Lamb . | |
| 5,315,798 | * | 5/1994 | Zarwell | 49/463 X |
| 5,319,884 | * | 6/1994 | Bergeron | 49/504 |

* cited by examiner

*Primary Examiner*—Daniel P. Stodola
*Assistant Examiner*—Hugh B. Thompson
(74) *Attorney, Agent, or Firm*—Simpson, Simpson & Snyder, L.L.P.

(57) ABSTRACT

"A security window assembly comprising a frame having four members and a pane member securable within the frame. The bottom member of the frame contains a milled groove. The top member of the frame contains a stepped groove having a first groove of a first depth and a second groove of a second and deeper depth. The pane is installed by sliding it into the second depth groove to allow it clearance to then be installed in the bottom member groove. The pane can only be removed by sliding it into the second depth groove which removes the pane from the bottom member groove. When in place in the window, the pane is positioned within the bottom member groove and within the first depth groove of the top member. Clamps hold the pane in place."

16 Claims, 5 Drawing Sheets

SECURITY WINDOW ASSEMBLY

FIELD OF THE INVENTION

This invention relates generally to windows and window assemblies, and, more particularly, to security window assemblies.

BACKGROUND OF THE INVENTION

Every year, millions of residential break-ins and burglaries occur in the United States. In selecting a point of entry for a residential break-in, burglars often select an entry point which is free from the view of the street and unlikely to be noticed by a person in the home. Obviously, windows, and especially basement windows are prime targets for burglars.

There are many deterrents to burglary on the market. These include sophisticated electronic alarm devices and security systems, motion detectors, and the like. Physical barriers to intruders are also well known, such as fences, window bars, shutters and the like. A variety of locking devices for doors and windows are also well known.

One known barrier to intrusion through a basement window are so-called "glass-block" windows. These windows are made of heavy gauge glass blocks, fused together to form a solid barrier. Some glass-block window assemblies include small vents, whereas others do not. The vents are large enough for ventilation, but too small for entry or even for transferring objects into or out of a basement. Glass-block assemblies also offer privacy in that an outsider cannot see through them.

Despite the advantages of glass-blocks, these assemblies offer several disadvantages. First, homeowners often desire to transfer objects into and out of their basements via basement windows, as this is often much easier, safer and cleaner than bringing items through the house itself and down the basement stairs. This is especially true for home craftsmen, who wish to bring lumber and supplies into a basement workshop. Unfortunately, transfer is impossible through glass-block windows. Glass-block windows can also be dangerous in the event of an emergency. It is impossible to escape a basement having glass block windows in the event of a fire or should residents flee to the basement in the event of an aboveground break-in. Finally, the vents in glass-block windows are usually too small to properly ventilate a room, especially in unusual circumstances such as a carbon monoxide leak, or for purposes of painting or home-craftsman furniture finishing, etc.

Thus, it is seen that there is a need for a new security window assembly that overcomes the disadvantages of glass-block and other security windows. An ideal security window would offer as much if not more security than traditional glass-block assemblies and yet also offer ventilation and escape capability when needed.

SUMMARY OF THE INVENTION

The invention broadly comprises a security window assembly for a structure, comprising a top member having an outwardly-facing surface and an inwardly-facing surface, the top member having a stepped-groove extending from the inwardly-facing surface, the stepped-groove having at least a first depth and a second depth extending deeper than the first depth, a first side member secured to the top member, a second side member secured to the top member, a bottom member secured to the first and second side members, the bottom member having an outwardly-facing surface and an inwardly-facing surface, the bottom member having a groove extending from the inwardly-facing surface, the groove arranged in alignment with the first depth groove of the stepped-groove of the top member, a pane member operatively arranged to be secured within the first depth groove of the stepped-groove of the top member and the groove of the bottom member, and, clamping means operatively arranged to hold the pane member securely within the first depth groove of the stepped groove of the top member and the groove of the bottom member, the clamping means accessible only from inside of the structure.

A primary object of the invention is to provide a security window assembly for a structure which provides both security against intruders and yet capability of fast and easy escape from within when necessary.

Another object of the invention is to provide a security window assembly for a structure which permits adequate ventilation of the room in which the window assembly is installed when desired.

A further object of the invention is to provide a security window assembly for a structure which can be easily installed over existing non-security window assemblies, or, alternatively, be installed in a newly constructed building or structure.

These and other objects, features and advantages of the present invention will become readily apparent to those having ordinary skill in the art from the following detailed description of the invention in view of the drawings and appended claims.

DETAILED DESCRIPTION OF THE PREFERRED EMBODIMENT

Figure 1:
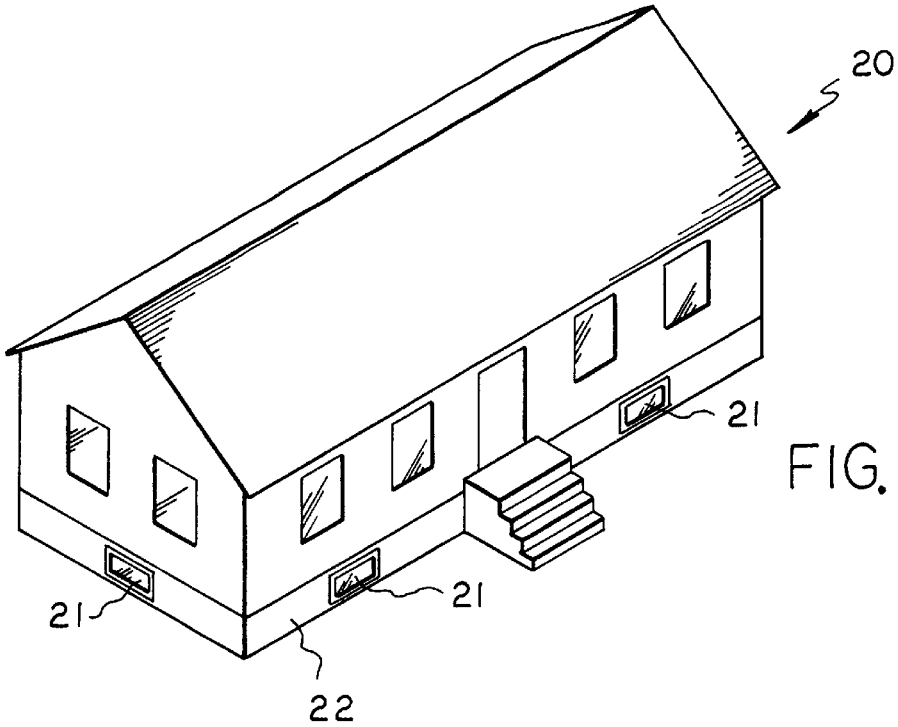
FIG. 1 is a perspective view of a typical structure having non-security windows which can be easily retrofit with the security window assembly of the present invention.

At the outset, it should be clearly understood that like reference numerals are intended to identify the same structural elements, portions or surfaces consistently throughout the several drawing figures. as such elements, portions or surfaces may be further described or explained by the entire written specification, of which this detailed description is an integral part. Unless otherwise indicated, the drawings are intended to be read together with the specification, and are to be considered a portion of the entire "written description" of this invention. With respect to the window assembly itself, the terms "inwardly-facing" and "outward-facing" refer to directions away from, and toward the structure in which the assembly is installed, respectively. With respect to the pane member, the terms "inwardly facing" and "outwardly facing" refer to directions facing the interior and exterior of the structure in which the assembly is installed, respectively.

It should be noted that although the present invention is ideally suited for installation in residential dwellings, the invention is equally suitable for commercial buildings. Also, although the drawings illustrate the invention being installed as a basement window assembly, the invention is not so limited. It can be installed anywhere in a structure. Finally, a preferred clamping means for holding the pane member in place is disclosed in the detailed description, but other means of holding the pane member in place should be readily apparent to those having ordinary skill in the art.

Figure 2:
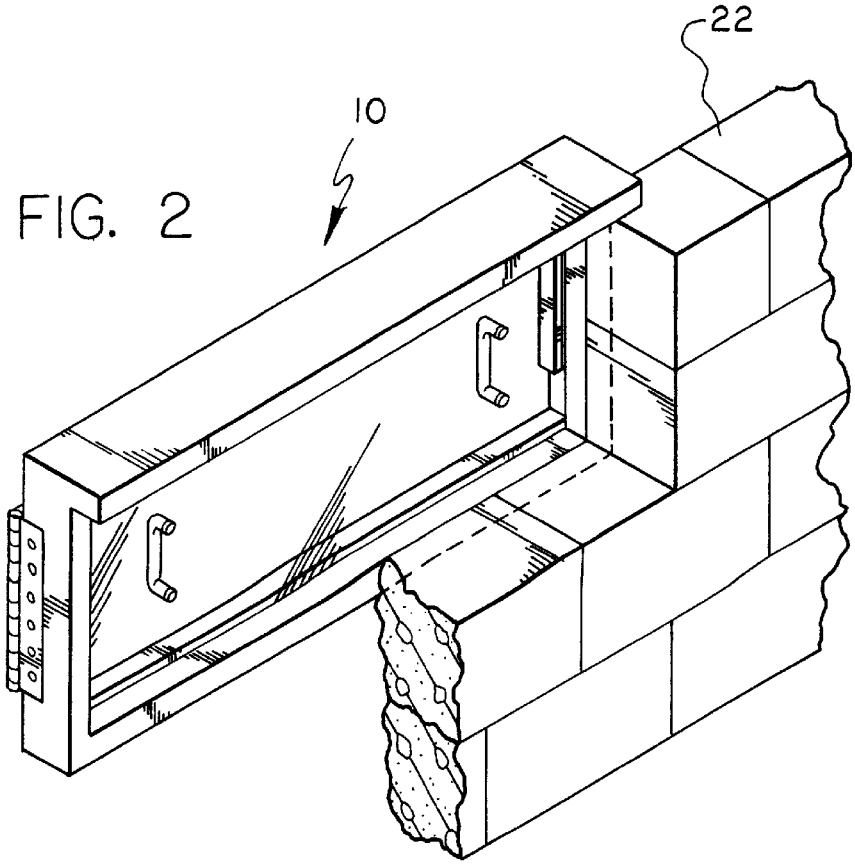
FIG. 2 is a fragmentary perspective view of a section of the foundation of the structure shown in FIG. 1, showing the non-security window assembly removed, and the structure retrofitted with the security window assembly of the present invention.

Adverting now to the drawings, FIG. 1 illustrates structure 20 in perspective. In this drawing, the structure happens to be a residential home, but the structure can be any building. The structure is shown as having a foundation 22 and existing non-security window assemblies 21. There are a number of ways in which the security window assembly of the present invention may be installed in structure 20. In FIG. 2, a preferred method of installation is shown, where the non-security window has been removed, and security window assembly 10 is shown being retrofit in its place. Thus, the frame of the security window assembly of the invention installs in the same manner and in the same space as existing non-security window assemblies.

Figure 3:
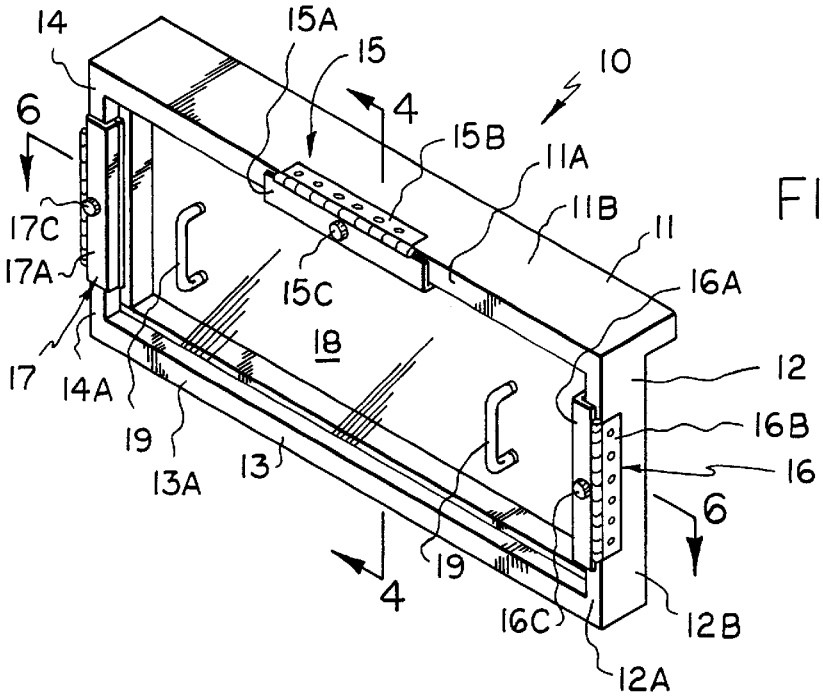
FIG. 3 is a perspective view of a first embodiment of the present invention, as seen from the inside of a structure in which the window assembly would be installed.

FIG. 3 is a perspective view of a preferred embodiment of the invention. Security window assembly 10 comprises top member 11, a first side member 12 secured to the top member, a second side member 14 secured to the top member, a bottom member 13 secured to the first and second side members, and pane member 18 secured within the assembly by clamping means 15, 16 and 17. The window assembly of FIG. 3 is shown from the perspective of one looking at the window from inside a structure in which the window assembly would be installed. In other words, handles 19 and clamps 15, 16 and 17 (which will be described infra) would be accessible only from inside the structure.

As shown in FIG. 3, clamping means 15 comprises hinge member 15B secured to surface 11B of top member 11 and screw 15C which extends through hinge member 15A to clamp pane member 18 in place. Similarly, clamping means 16 comprises hinge member 16B secured to surface 12B of side member 12 and screw 16C which extends through hinge member 16A to clamp pane member 18 in place. Finally, clamping means 17 comprises hinge member 17B secured to surface 14B (shown in FIG. 6) of side member 14 and screw 17C which extends through hinge member 17A to clamp member 17A against surface 14A. Operation of the clamping means will be described infra.

Pane member 18 may be made of any suitable material, and obviously should be strong and shatterproof. Ideal choices for pane material are polycarbonate and armored glass, although other plastic materials are also suitable. The exterior surface of the pane member should be smooth and flat to make it difficult for potential intruders to grab it with their hands.

Figure 4:
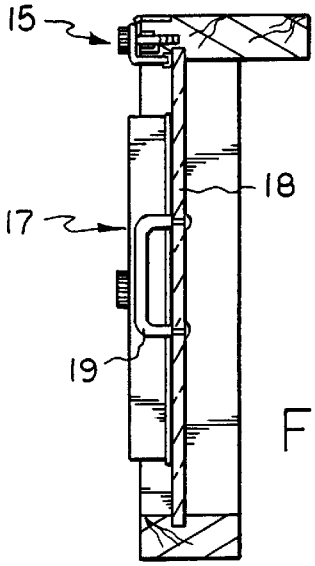
FIG. 4 is a cross-sectional view of the window assembly shown in FIG. 3, taken generally along plane 4—4 in FIG. 3.
Figure 5:
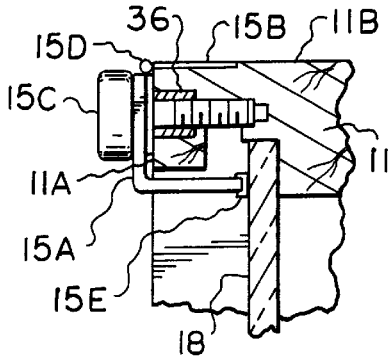
FIG. 5 is an enlarged fragmentary view of the clamping means shown in FIG. 4.

Pane member 18 is shown clamped in place in the window assembly in FIG. 4, which is a cross-sectional view of the window assembly taken generally along plane 4—4 in FIG. 3. The clamping mechanism is best shown in enlarged view in FIG. 5, which shows how clamping means 15 functions. Clamping means 15 comprises hinge member 15B which is fixedly secured to surface 11B of top member 11. Hinge member 15A is normally free to pivot about pivot pin 15D. Threaded ferrule 36 is also fixedly secured within top member 11. Screw 15C is shown in tight threaded engagement with threaded ferrule 36, forcing hinge member 15A into contact with surface 11A of top member 11. Mounted to an end of hinge member 15A is resilient member 15E. As screw 15C is turned clockwise, the threaded part of the screw engages the threaded ferrule, forcing hinge member 15A to contact surface 11A, and resilient member 15D to contact pane member 18, holding the pane in place in the frame as shown.

Figure 6:
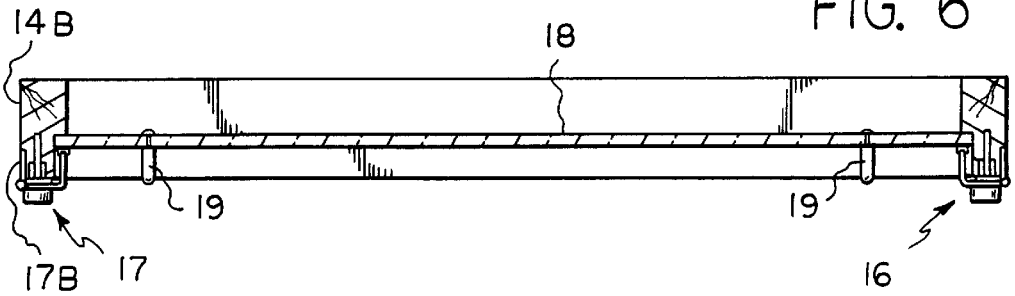
FIG. 6 is a cross-sectional view of the window assembly shown in FIG. 3, taken generally along plane 6—6 in FIG. 3.

Side clamps 16 and 17 function in the exact same way, as illustrated best in FIG. 6 which is a cross-sectional view of the window assembly shown in FIG. 3, taken generally along plane 6—6 in FIG. 3. As seen in this view, side clamps 16 and 17 are functioning to securely clamp pane 18 in place in the window assembly.

Figure 8:
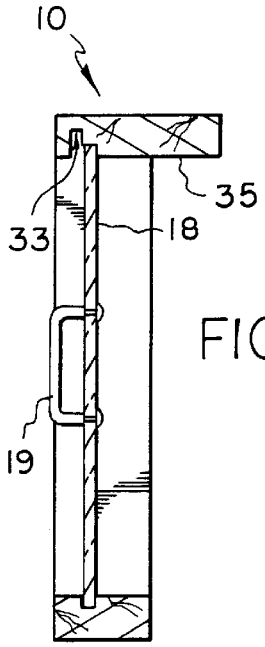
FIG. 8 is a cross-sectional view of the window assembly of FIG. 7, taken generally along plane 8—8 in FIG. 7, and showing the pane member in the clamped secure position.
Figure 11:
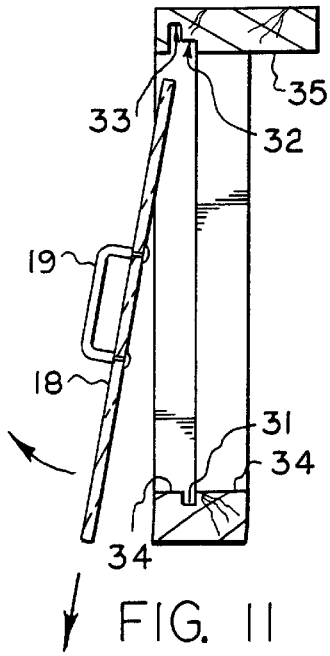
FIG. 11 is a view identical to that of FIG. 10 but showing the pane member being removed from the window assembly.

As best shown in FIGS. 8 and 11, pane member 18 is held in place in first depth groove 32 in top member 11 and groove 31 in bottom member 11. Top member 11 contains a stepped groove comprising first depth groove 32 and second depth groove 33, both of which extends into member 11 from surface 35. Second depth groove is shown as being deeper than first depth groove 32. This combination of different depth grooves both facilitates easy installation and removal of the pane, and adds security. Since the groove structure is normally hidden from view, a potential intruder cannot readily discern how the pane is removed.

Figure 7:
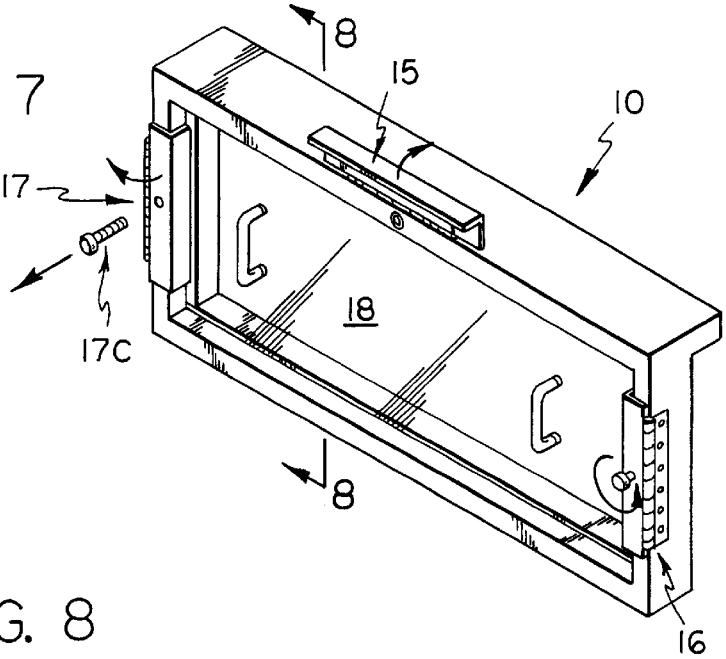
FIG. 7 is a perspective view similar to that of FIG. 1, but showing the clamps being removed to illustrate how the pane member is removed from the window assembly.

Removal is best illustrated in FIGS. 7–11. In FIG. 7, the pane member is in place in the assembly, clamping means 15 has been removed; clamping means 17 is in the process of being removed; and clamping means 16 is about to be removed. Even with the clamps removed, as shown in cross-sectional view in FIG. 8, it is still extremely difficult to remove the pane from the outside of the structure, due to the difficulty of grasping the pane, and the non-visible structure and function of the stepped groove in the top member and the groove in the bottom member of the assembly. However, the pane can be easily moved, maneuvered, and removed from the inside of the structure with handles 19.

Figure 9:
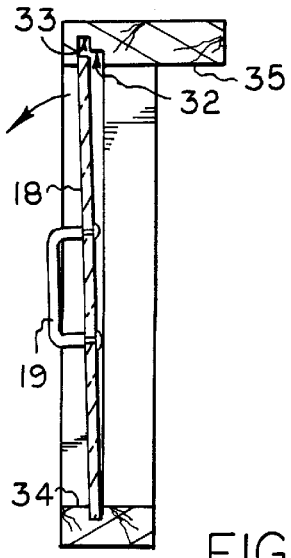
FIG. 9 is a view identical to that of FIG. 8 but showing the pane member being tilted to align it for removal.
Figure 10:
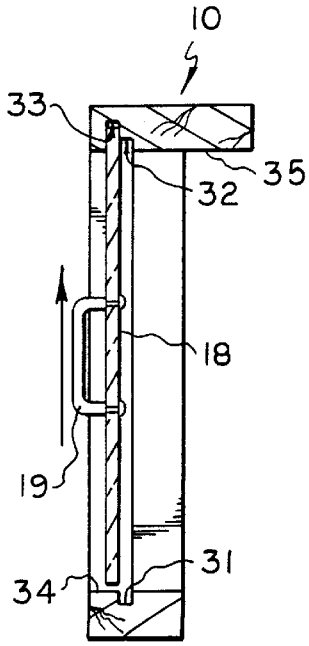
FIG. 10 is a view identical to that of FIG. 9 but showing the pane member being elevated for removal.

Once the clamps have been removed as shown in FIG. 8, the next step in removal is shown in FIG. 9, where the pane is shown tilted into alignment with the deeper of the stepped grooves in the top member. The pane must then be lifted upwardly into second depth groove 33 as shown in FIG. 10, which simultaneously removes the bottom of the pane from groove 31, which extends downwardly from surface 34. Finally, the pane can be tilted and removed from the assembly as shown in FIG. 11. It should be noted that the groove widths are selected to provide some clearance to permit the above-described maneuvering. It is not necessary or even desired that the pane fit snugly, (i.e., an interference fit), in the grooves, since the pane is further held in place by the clamping means. Thus it is seen that the invention provides an extremely secure window assembly, difficult to penetrate from the outside, yet with a pane that can be easily removed for quick escape from the inside.

Figure 12:
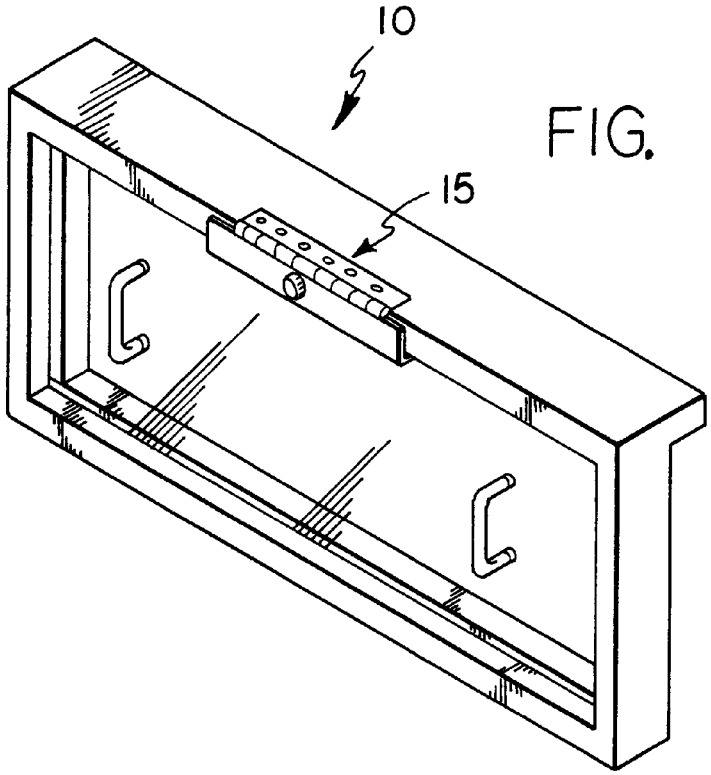
FIG. 12 is a perspective view of a second embodiment of the present invention, having clamping means only on the top member of the window assembly.
Figure 13:
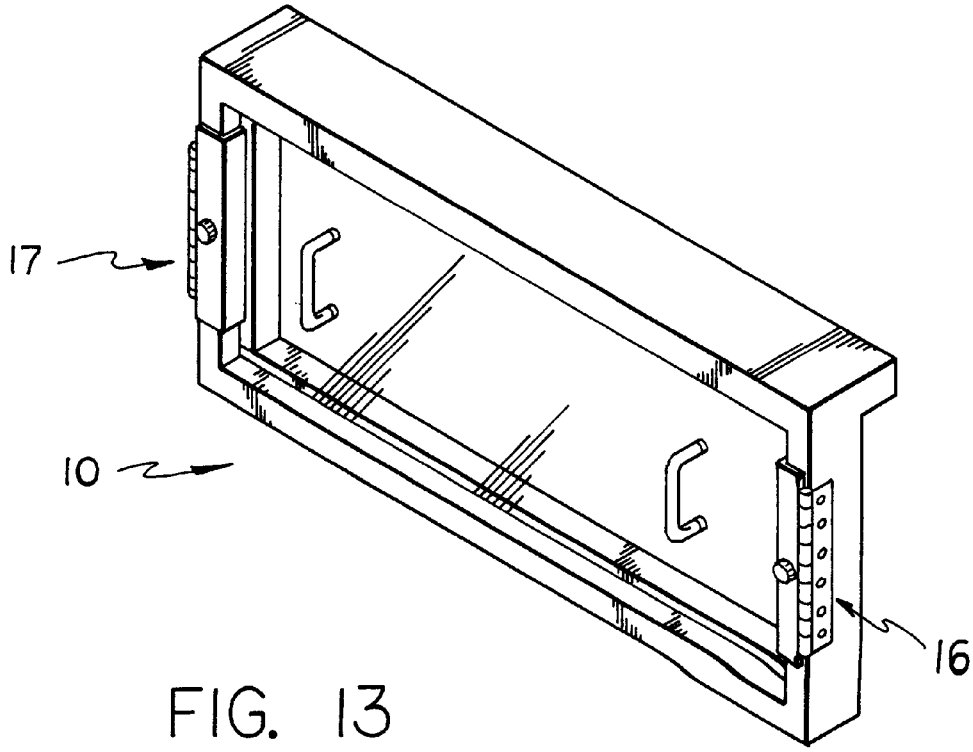
FIG. 13 is a perspective view of a third embodiment of the present invention, having clamping means only on the two side members of the window assembly.

An alternative embodiment of the invention is shown in FIG. 12. In this embodiment, only a single clamping means 15 is used to hold the pane member in place. Yet another embodiment is shown in FIG. 13 where two clamping means 12 and 14 are used to hold the pane in place from the sides of the window assembly. As mentioned previously, the clamping means shown and described herein are representative only, as it should be readily apparent to those having ordinary skill in the art that a variety of suitable types of clamps could be used to hold the pane in place.

Figure 14:
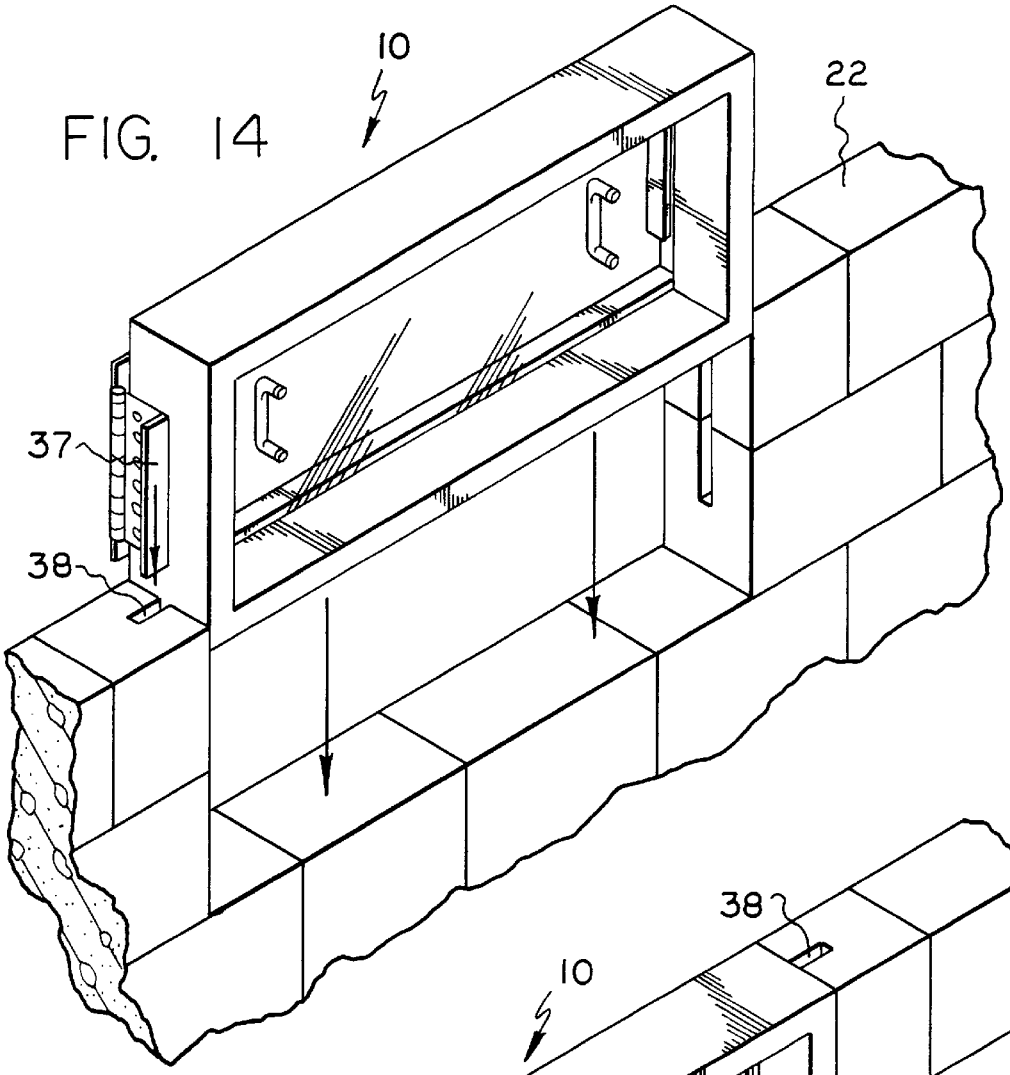
FIG. 14 is a perspective view of a fourth embodiment of the present invention, illustrating tongue and groove installation of the window assembly into a foundation of a structure; and, FIG. 15 is a view similar to that of FIG. 14 taken after the window assembly has been installed.
Figure 15:
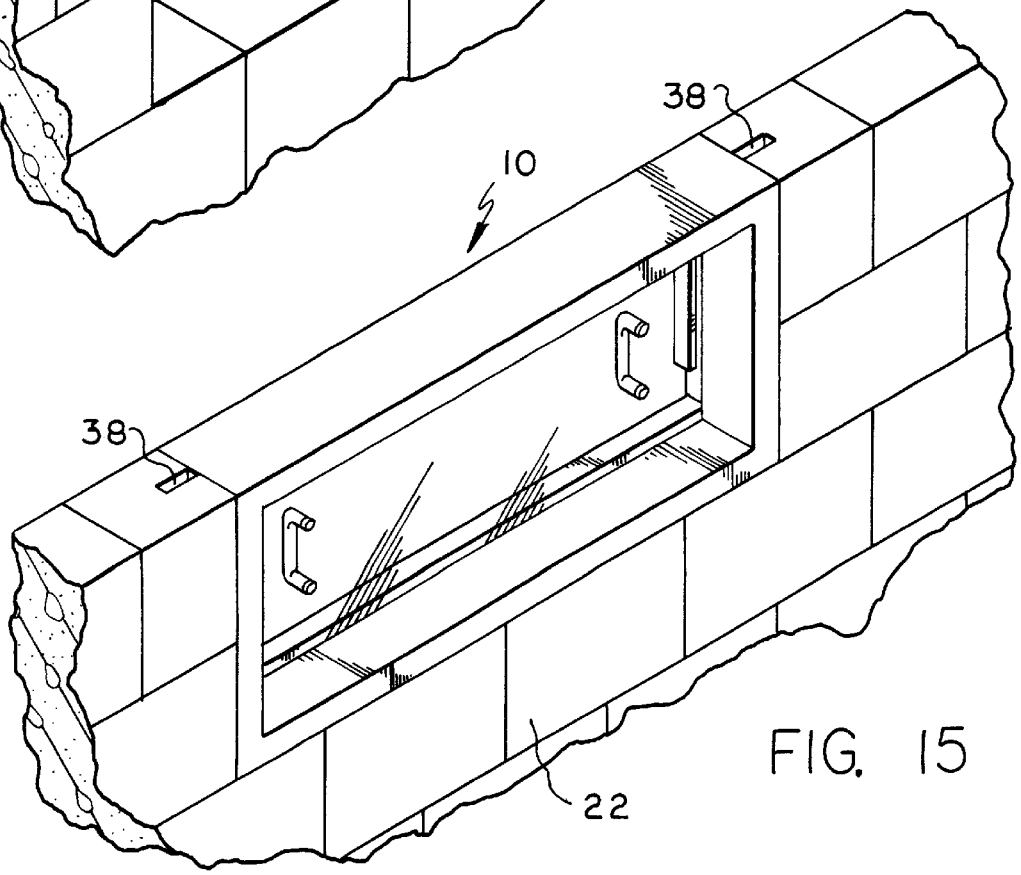

Although the security window assembly may be easily retrofit in existing homes and other buildings, an improved embodiment of the invention can be installed in new construction, as shown in FIGS. 14 and 15. In this embodiment, tongue 37 is fixedly secured to the side members of the window assembly and arranged to align and mate with groove 38 in foundation 22, providing a secure installation.

Thus, the objects of the invention are efficiently obtained. Although the invention is described by reference to specific preferred embodiments, it is clear that variations can be made without departing from the spirit of the invention as claimed. For example, with respect to the groove structure, it should be readily apparent that the stepped groove could be located in the bottom window assembly member, with a single groove in the top member. Although not preferred, the stepped groove assembly could be eliminated entirely, with the pane being held in place only by a single groove in combination with the clamps.

What I claim is:

1. A security window assembly for a structure, comprising:

a top member having an outwardly-facing surface and an inwardly-facing surface, said top member having a stepped-groove extending from said inwardly-facing surface, said stepped-groove having a first groove having a first depth, and a second adjacent groove having a second depth, where said second depth is greater than said first depth;

a first grooveless side member secured to a first end of said top member, said first side member having a first rabbet therein;

a second grooveless side member secured to a second end of said top member, said second side member having a second rabbet therein;

a bottom member having a first end secured to said first side member and a second end secured to said second side member, said bottom member having an outwardly-facing surface and an inwardly-facing surface, said bottom member having a single groove extending from said inwardly-facing surface, said single groove arranged in alignment with said first groove of said top member;

a pane member operatively arranged to be secured within said first groove of said top member and said single groove of said bottom member; and, clamping means operatively arranged to hold said pane member securely within said first groove of said top member and said single groove of said bottom member and against said first and second rabbets of said first and second side members, respectively.

2. A security window assembly as recited in claim 1 wherein said pane member is made of plastic.

3. A security window assembly as recited in claim 1 wherein said pane member is made of polycarbonate.

4. A security window assembly as recited in claim 1 wherein said pane member is made of armored glass.

5. A security window assembly as recited in claim 1 wherein said pane member is transparent.

6. A security window assembly as recited in claim 1 wherein said pane member is translucent.

7. A security window assembly as recited in claim 1 wherein said pane member is opaque.

8. A security window assembly as recited in claim 1 wherein said clamping means comprises a threaded rod secured to a knob turnable by hand to position and lock a hinge member against said pane member within said first depth groove of said stepped-groove of said top member and said groove of said bottom member.

9. A security window assembly as recited in claim 8 wherein said threaded rod clamping means is secured by a hinge member to said top member.

10. A security window assembly as recited in claim 8 wherein said window assembly comprises two or more of said clamping means.

11. A security window assembly as recited in claim 10 wherein a first clamping means is secured to said top member, a second clamping means is secured to said first side member, and a third clamping means is secured to said second side member.

12. A security window assembly as recited in claim 1 wherein said top member further comprises a flange extending therefrom adapted to mount said security window over an existing non-security window.

13. A security window assembly as recited in claim 1 wherein said first and second side members further comprise outwardly extending tongues adapted to matingly engage grooves in a foundation of a structure to hold said assembly in place within said structure.

14. A security window assembly as recited in claim 1 wherein said pane member includes a smooth, planar surface.

15. A security window assembly as recited in claim 1 further comprising a handle member secured to an inwardly facing surface of said pane member to facilitate installation and removal of said pane member into and out of said window assembly.

16. A security window assembly as recited in claim 1 further comprising a pair of handles secured to an inwardly facing surface of said pane member to facilitate installation and removal of said pane member into and out of said window assembly.

* * * * *